United States Patent [19]

Hofsäss

[11] Patent Number: 4,887,063

[45] Date of Patent: Dec. 12, 1989

[54] INSULATING CASING FOR THERMAL SWITCHES

[76] Inventor: Peter Hofsäss, Strietweg 45, D-7530 Pforzheim, Fed. Rep. of Germany

[21] Appl. No.: 241,479

[22] Filed: Sep. 8, 1988

Related U.S. Application Data

[63] Continuation of Ser. No. 61,227, Jun. 12, 1987, abandoned.

[30] Foreign Application Priority Data

Jun. 14, 1986 [DE] Fed. Rep. of Germany ... 8616132[U]

[51] Int. Cl.[4] ..... H01H 37/04

[52] U.S. Cl. ..... 337/380; 200/294; 337/112

[58] Field of Search ..... 337/112, 381, 113, 380, 337/398; 174/52 R, 52 PE; 165/80, 185; 200/289, 293, 294, 302.1, 302.2, 303; 361/331, 334, 380, 379, 382-389, 395, 399, 415

[56] References Cited

U.S. PATENT DOCUMENTS

| | | | |
|---|---|---|---|
| 3,710,193 | 1/1973 | Greenberg | 361/388 |
| 3,721,865 | 3/1973 | Rademaker | 174/52 R |
| 3,801,874 | 4/1974 | Stefani | 361/388 |
| 3,964,009 | 6/1976 | Bernstein | 174/52 R |
| 4,417,226 | 11/1983 | Asdollahi | 337/279 |
| 4,436,951 | 3/1984 | Rief | 361/388 |
| 4,519,015 | 5/1985 | Lin | 361/399 |
| 4,533,976 | 8/1985 | Suwa | 361/395 |
| 4,641,121 | 2/1987 | Boulanger | 337/380 |

*Primary Examiner*—Gerald P. Tolin

*Attorney, Agent, or Firm*—Antonelli, Terry & Wands

[57] ABSTRACT

An insulating casing for enclosing a thermal switch, with the insulating casing having a plastic envelope, in which at least one oxide ceramic part is arranged on one side of the thermal switch, between the latter and the envelope.

7 Claims, 2 Drawing Sheets

INSULATING CASING FOR THERMAL SWITCHES

This is a continuation application in Ser. No. 061,227, filed June 12, 1987, now abandoned.

BACKGROUND OF THE INVENTION

The present invention relates to an insulating casing or housing for thermal switches having a plastic envelope or jacket.

Insulation for thermal switches, particularly miniature bimetallic switches are known in various different constructional forms. In, for example, German utility model 73 33 932 a switch is proposed with an insulation formed from a deep-drawn plastic cap which is engaged on the switch and snugly surrounds the latter except for the connecting face, which is embedded by a casting resin. It is also proposed in DE-OS 27 28 487, inconnection with switches with a snugly surrounding insulating material cap, to pressure extrusion coat at least the free part of the switch, i.e. in particular in the vicinity of the connecting elements. Finally, it has been proposed in German Utility Model 8028913 that an envelope comprising a thermoplastic casing cup, in which the component, i.e. particularly a switch is inserted and a casing cover connected therewith by an ultrasonic weld be used.

This insulating casing fulfills the important function in connection with thermal switches of ensuring a good heat conduction from the outer area to the thermal switch, so that the latter rapidly and reliably responds to temperature changes. The known insulating casing has very thin plastic walls, so that they are unable to satisfy the protection requirements of higher protection classes. In order to satisfy these protection requirements much thicker insulating casing walls would be required, which would reduce the quality of the overall insulated thermal switch, particularly with respect to its response speed and would even make such a switch unusable.

The aim underlying the present invention essentially resides in providing an insulating casing for thermal switches which, in the case of high insulating properties, still ensures a good and rapid heat transfer from the outside to the switch located in the casing.

SUMMARY OF THE INVENTION

According to the invention, an insulating casing of the aforementioned type, is provided with at least one one side of the thermal switch between the latter and the envelope being provided at least one oxide ceramic part. According to a preferred development of the inventive insulating casing, the oxide ceramic parts are arranged on the side remote from the switch connecting contacts. It is also advantageously provided that the plastic envelope is a pre-extruded envelope, which has an insertion side with a guide into which are inserted the oxide ceramic parts. Moreover, between a base or bottom of the plastic envelope constructed on the side remote from the switch connections guide slots are formed, into which the oxide ceramic parts are inserted. The insertion opening of the pre-extruded insulating casing is closed following the introduction of the switch and oxide ceramic plates, e.g. in a known manner by casing or pressure extrusion. In particular a in the case of a plate-like construction of the oxide ceramic parts, it has surprisingly been found that the response speed is even higher than when no such part is provided for the same envelope thickness. The envelope can be made from random plastics, whereby, in the case of higher temperatures, it is preferable to use thermoset resins rather than thermoplastics. The oxide ceramic is preferably MgO or alumina ceramic, which have a good heat conduction in the case of a good insulation behavior. This could, in particular, be on the flat heat transfer path formed through the oxide ceramic parts. It is fundamentally possible to substitute one oxide ceramic part, but preferably two small plates are used.

According to a preferred development of the invention, the casing comprises a lower part and an upper part, which can be positively inserted in one another, while merely leaving passages for connecting lines or leads. This permits a simple assembly of the overall switch. This construction also makes it possible to satisfy insulating requirements, in that in a further preferred construction one part carries two webs having a relative spacing, between which, apart from the cavity for the switch and ther ceramic parts, is formed a further air chamber, with the webs being close to the connecting lines. According to a further development, in order to reliably and firmly retain the ceramic plates, the upper part has at least one shoulder through which, when the casing is assembled, the ceramic parts are pressed against the bottom of the lower part.

BRIEF DESCRIPTION OF THE DRAWINGS

The invention is described in greater detail hereinafter relative to non-limitative embodiments of the inventive insulating casing and with reference to the attached drawings.

DETAILED DESCRIPTION OF THE INVENTION

Figure 1:
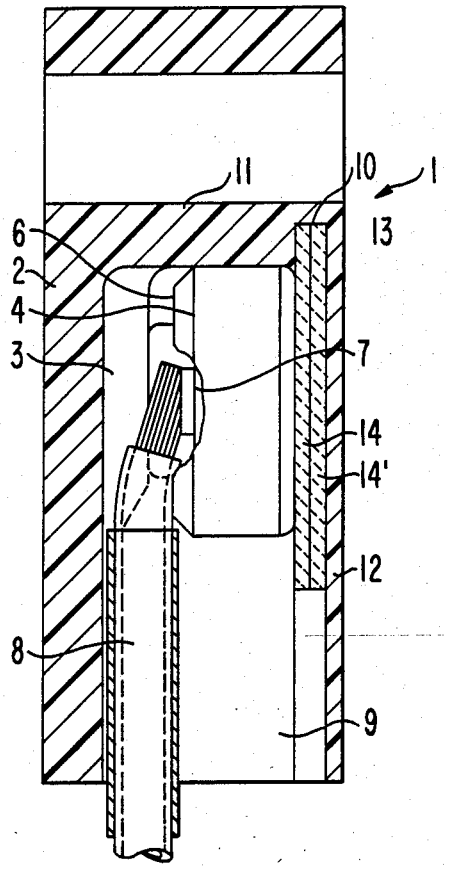
FIG. 1, is a longitudinal section through the inventive insulating casing.
Figure 2:
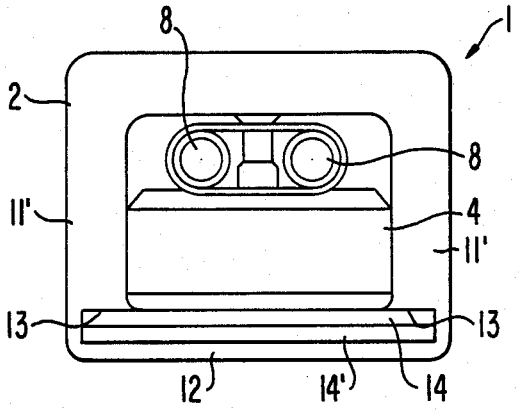
FIG. 2, is a view of the insulating casing in the direction of the insertion opening, when the latter is still open.

Referring now to the drawings wherein like reference numerals are used throught out the various views to designate like parts and, more partiicularly, to FIGS. 1 and 2, according to these figures, in insulating casing generally designated by the reference numeral 1, enclosing a thermal switch, has a preextruded plastic envelope 2, which has a cavity 3 for receiving the thermal switch 4. On one side 6, the thermal switch 4 has two connecting contacts or terminals 7, to which are fixed connecting lines or leads 8, particularly by soldering and which are led out of the casing 1 through an insertion opening 9. Thermal switch 4 has a metal casing, which is in contact with one of the contacts 7 and one of the connecting lines 8 and is consequently a live part. While the parts of the envelope 2 on the side of contacts 7 and connecting lines 8, as well as in the vicinity of face of envelope 2 have an adequate thickness, particularly of more than 2 mm for fulfilling given insulating requirements, the side of the envelope remote from contacts 7 is extremely thin, so that it essentially only satisfies mechanical and stability requirements. Above the thin base or bottom 12, between the same and the thickened side walls 11, slots 13 are formed on either side of recess 10 and on one face and into them are inserted superimposed oxide ceramic parts 14, 14' and whereof one part 14' engages with its underside on the thin wall 12 and whereof the other part 14 engages with its top surface on the bottom of thermal switch 4 remote from contacts 7. Ceramic parts 14, 14' are highly insulating, so that with only limited thickness they satisfy the necessary high demands of dielectric strength tests and there is an insulation satisfying requirements on the side of the bottom of the switch. Nevertheless the high response rate of the thermal switch to temperature increases in ensuremd, because the additional ceramic pats 14, 14', apart from their insulating properties as such and also in the case of the limited thickness with which they can be used, permit a good heat conduction. Fundamentally there need only be one ceramic part or several parts can be superimposed and in all cases the thickness of the complete ceramic layer can be kept limited by a correspondingly small plate thickness.

Figure 3:
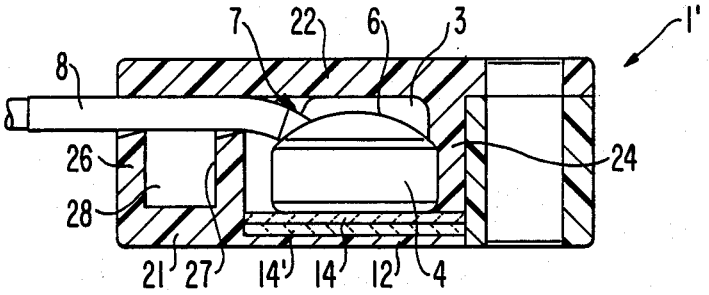
FIG. 3, is a section through another embodiment of the insulating casing.

In the construction according to FIG. 3, a two-part, preshaped casing 1' is provided which includes a lower part 21 and an upper part 22, which are adapted to one another in such a way that, while leaving the cavity 3 for the oxide ceramic parts 14, 14' and the actual thermal switch, they can be positively engaged firmly in one another. The upper part 22 has shoulders or lugs 24 engaging in the lower part 21 and do not extend to the bottom 12 of lower part 21, instead leaving a space such that the ceramic plates 14, 14' to be inserted are firmly pressed by shoulders 24 against the bottom 12 of lower part 21 and the shape is maintained by shoulders 24.

In the vicinity of connecting lines 8 the lower part 21 has webs 26, 27 extending vertically to its base surface 12 and which are spaced from one another in such a way that an air chamber 28 is formed in addition to the cavity 3. Together with the area of upper part 22 located above them, webs 26, 27 tightly enclose the connecting lines 8. As a result of the construction of the webs and the spacing thereof, an adequate striking and creepage distance is obtained, whose size can be in accordance with the particular requirements.

The upper and lower parts are tightly placed in one another. Optionally, in the vicinity of their contact seam, they can be welded together, e.g. ultrasonically.

What is claimed is:

1. A casing enclosing a bimetallic switch having connecting lines extending therefrom, the casing comprising a plastic envelope including a lower part and an upper part positively inserted in one another while merely leaving passage means for accommodating the connecting lines, at least one oxide ceramic plate member located in the casing, wherein the upper part has at least one shoulder through which the at least one ceramic plate member is pressed against a bottom of the lower part, and wherein the lower part includes two spaced webs forming an air chamber separate from a space accommodating the bimetallic switch and the at least one oxide ceramic plate member, said two spaced webs tightly engaging the connecting lines.

2. An insulating casing enclosing a miniature bimetallic switch for monitoring ambient temperature changes and for providing a switching response upon an occurrence of a predetermined temperature change, said insulating casing comprising a plastic envelope, wherein at least one oxide ceramic plate member is located in the plastic envelope on at least one side of the bimetallic switch, between said bimetallic switch and the plastic envelope and is surrounded by said plastic envelope.

3. A casing according to claim 2, wherein a plurality of oxide ceramic plate members are provided and arranged on a temperature-sensitive side of the bimetallic switch remote from connecting contacts of the bimetallic switch.

4. A casing according to claim 2, wherein the plastic envelope is a pre-extruded envelope having an insertion side including a guide into which the at least one oxide ceramic plate member is inserted.

5. A casing according to claim 2, wherein guide groove means are located between a base of the plastic envelope on a switch side remote from connecting of the bimetallic switch and side walls of the plastic envelope, and wherein the at least one oxide ceramic plate member is inserted into said guide groove means.

6. A casing according to claim 2, wherein the plastic envelope includes a lower part and an upper part positively inserted into one another while merely leaving passage means for accommodating connecting lines to the miniature bimetallic switch.

7. A casing according to claim 6, further comprising at least one oxide ceramic plate member and wherein the upper part has at least one oxide shoulder through which the at least one ceramic plate member is pressed against a bottom of the lower part.

* * * * *